US006512904B2

(12) United States Patent
Sato et al.

(10) Patent No.: US 6,512,904 B2
(45) Date of Patent: Jan. 28, 2003

(54) RECORDING MEDIUM FEED PATH FOR AN IMAGE FORMING APPARATUS

(75) Inventors: Fumikazu Sato, Inuyama (JP); Satoru Ishikawa, Aichi-ken (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/935,595

(22) Filed: Aug. 24, 2001

(65) Prior Publication Data

US 2002/0025187 A1 Feb. 28, 2002

(30) Foreign Application Priority Data

Aug. 25, 2000 (JP) ..... 2000-255910

(51) Int. Cl.[7] ..... G03G 21/16; G03G 15/16
(52) U.S. Cl. ..... 399/111; 399/316; 399/388
(58) Field of Search ..... 271/188, 242; 399/21, 111, 388, 316, 361, 381

(56) References Cited

U.S. PATENT DOCUMENTS 5,424,818 A * 6/1995 Yoshimura et al. ..... 399/111

* cited by examiner

*Primary Examiner*—Hoang Ngo
(74) *Attorney, Agent, or Firm*—Oliff & Berridge, PLC

(57) ABSTRACT

An image forming apparatus includes a photosensitive drum and a transfer roller disposed opposite to the photosensitive drum. Provided upstream of the transfer roller in a paper sheet feeding direction is a roller that guides a paper sheet between the photosensitive drum and the transfer roller. The roller is disposed at such a position that the paper sheet is brought into a surface of the photosensitive drum and then supplied between the photosensitive drum and the transfer roller. With the above-described structure, a gap is not formed between the paper sheet and the photosensitive drum, so that poor image transfer attributable to an electric discharge, that occurs at the gap, can be prevented.

25 Claims, 4 Drawing Sheets

RECORDING MEDIUM FEED PATH FOR AN IMAGE FORMING APPARATUS

BACKGROUND OF THE INVENTION

1. Field of Invention

The invention relates to an image forming apparatus, such as a laser printer, that forms an image in an electrophotographic method and to a process unit removably set in the image forming apparatus.

2. Description of Related Art

A laser printer forms an image onto a sheet of paper in an electrophotographic method. More specifically, the laser printer includes a photosensitive drum, a charger, a scanner unit, a developing roller, and a transfer roller. As the photosensitive drum rotates, a surface of the photosensitive drum is uniformly charged by the charger. The scanner unit emits a laser beam based on image data. The laser beam scans across the charged surface of the photosensitive drum at high speed. Then, an electrostatic latent image is formed on the surface of the photosensitive drum. Toner carried on the developing roller is supplied to the electrostatic latent image, thereby developing the electrostatic latent image into a visible toner image on the surface of the photosensitive drum. When the sheet of paper passes between the photosensitive drum and the transfer roller, the toner image carried on the photosensitive drum is transferred onto the sheet by an electric field generated between the transfer roller and the photosensitive drum. In the above-described processes, the image is formed onto the sheet of paper.

In the laser printer, a rib that guides a sheet of paper between the photosensitive drum and the transfer roller is provided upstream of the transfer roller in a paper sheet feeding direction. The rib guides the paper sheet so as to bring the paper sheet into intimate contact with the surface of the photosensitive drum. Thus, the rib prevents a gap from being formed between the paper sheet and the photosensitive drum. If the gap is formed between the paper sheet and the photosensitive drum, electric discharge may occur at the gap due to a voltage applied to the transfer roller. However, such electric discharge can be prevented if the paper sheet is brought into intimate contact with the photosensitive drum, as described above.

However, when the visible toner image is transferred onto the paper sheet while being nipped between the photosensitive drum and the transfer roller, the paper sheet is pressed against the rib by a sheet transferring force at the nip portion. Consequently, the paper sheet continuously and frictionally slides on the rib while the paper sheet is conveyed. This makes the rib gradually wear down during a long period of usage of the laser printer. As the rib is worn, a gap is formed between the paper sheet and the photosensitive drum. When the electric discharge occurs at the gap due to the voltage applied to the transfer roller, poor image transfer is brought about.

SUMMARY OF THE INVENTION

An image forming apparatus of the invention may form a high-quality image over a long period of a usage thereof.

An image forming apparatus according to the invention may include a roller rotatably provided upstream of a transfer roller in a feeding direction of a recording medium. The roller guides the recording medium between a photosensitive drum and the transfer roller. As the roller is rotatably provided, friction between the recording medium and the roller may be reduced. Accordingly, wear or abrasion of the roller may be reduced. With the wear or abrasion of the roller reduced, a gap may not be formed between the photosensitive drum and the recording medium, so that electric discharge at the gap can be prevented.

It is preferable that a contact surface where the roller and the recording medium contact each other be disposed to a side of the photosensitive drum, with respect to a line tangent to a circumference of the photosensitive drum at an intersection of a line segment that links a center of the photosensitive drum and a center of the transfer roller.

By providing the contact surface where the roller and the recording medium contact each other, to the side of the photosensitive drum, the recording medium may be guided so as to come into intimate contact with the photosensitive drum. More specifically, the recording medium is brought into intimate contact with the surface of the photosensitive drum, so as to wind around a surface thereof before being fed between the photosensitive drum and the transfer roller. With such a structure, the occurrence of the electric discharge due to the bias applied to the transfer roller can be prevented. Accordingly, the poor image transfer can be prevented.

Even when the recording medium slides onto the contact surface of the roller while being pressed against the contact surface, friction generated between the roller and the recording medium may be reduced, because the roller is rotatably provided.

It is preferable that the photosensitive drum, the transfer roller, and the roller are provided in a process unit detachably set on the image forming apparatus, to facilitate maintenance of the image forming apparatus.

The photosensitive drum, the transfer roller, and the roller may be removed together, so that the positional accuracy of the photosensitive drum, the transfer roller, and the roller relative to each other may be improved. By the roller being mounted in improved positional accuracy, the recording medium may be properly guided so as to come into intimate contact with the photosensitive drum.

A contact surface where the recording medium and register rollers, provided upstream of the roller in a recording medium feeding direction, contact each other may be disposed in a lower portion, with respect to the contact surface where the roller and the recording medium contact each other.

With this structure, the recording medium receives a pressing force from the contact surface of the roller and is pulled between the transfer roller and the register rollers when the recording medium is held between the photosensitive drum and the transfer roller. The recording medium may be held between the photosensitive drum and the transfer roller without slack in the recording medium. Toner may be stably transferred onto the recording medium. Because the roller is rotatably provided, wear or abrasion of the roller due to sliding friction generated by the recording medium pressed against the roller can be reduced.

When the roller is structured so as to include a shaft and a plurality of disks provided in a lengthwise direction of the shaft with a predetermined distance therebetween, the roller having uniform dimensions may be formed by molding. Therefore, the recording medium may be properly guided by the roller accurately formed, so as to come into intimate contact with the photosensitive drum.

A supporting member that supports the recording medium guided by the roller may be provided between the transfer roller and the roller. The supporting member may be effective, especially when a trailing edge of the recording medium passes through the roller and comes out of the contact therewith, because the supporting member may support the trailing edge of the recording medium so as to prevent the trailing edge of the recording medium from slipping down between the transfer roller and the roller.

When a diameter of the roller is half a diameter of the transfer roller or smaller, the roller may be disposed at a position closer to a nip portion between the photosensitive drum and the transfer roller.

If the image forming apparatus of the invention is structured so as to collect the toner which remains on the photosensitive drum after an image transfer is finished, paper powders may possibly be collected together with the toner. However, by the use of the roller as in the invention, friction of the recording medium and the generation of the paper powders are reduced. That is, the mixture of paper powders into the toner to be collected can be prevented. Therefore, a reduction in the image quality can be prevented.

When the image forming apparatus is provided with a unit for forming an image on both sides of the recording medium, an electrical discharge is likely to occur due to the bias application when an image is to be formed on a side of the recording medium which already has an image formed on the other side thereof. However, by the use of the roller as in the invention, the recording medium may be guided so as to come into intimate contact with the photosensitive drum. Thus, the electrical discharge can be prevented.

The contact surface where the recording medium and register rollers contact each other may be disposed to a side of the transfer roller (lower side), with respect to the contact surface where the roller and the recording medium contact each other. In this case also, as described above, the recording medium receives a pressing force from the contact surface of the roller and is pulled between the transfer roller and the register rollers, through the roller. Toner may be stably transferred onto the recording medium.

With this structure, wear or abrasion of the roller due to sliding friction generated by the recording medium pressed against the contact surface of the roller may be reduced, because the roller is rotatably provided.

All of the photosensitive drum, the transfer roller, and the roller can be provided in a process unit. It is preferable that the process unit is detachably set in the image forming apparatus. By structuring the process unit so as to be detachably mounted on the image forming apparatus, the maintenance of the image forming apparatus is facilitated.

A high-quality image can be obtained by including the above-described features in the process unit.

BRIEF DESCRIPTION OF THE DRAWINGS

An exemplary embodiment of the invention will be described in detail with reference to the following figures wherein.

DETAILED DESCRIPTION OF PREFERRED EMBODIMENTS

An exemplary embodiment of the invention will be described in detail with reference to the figures.

Figure 1:
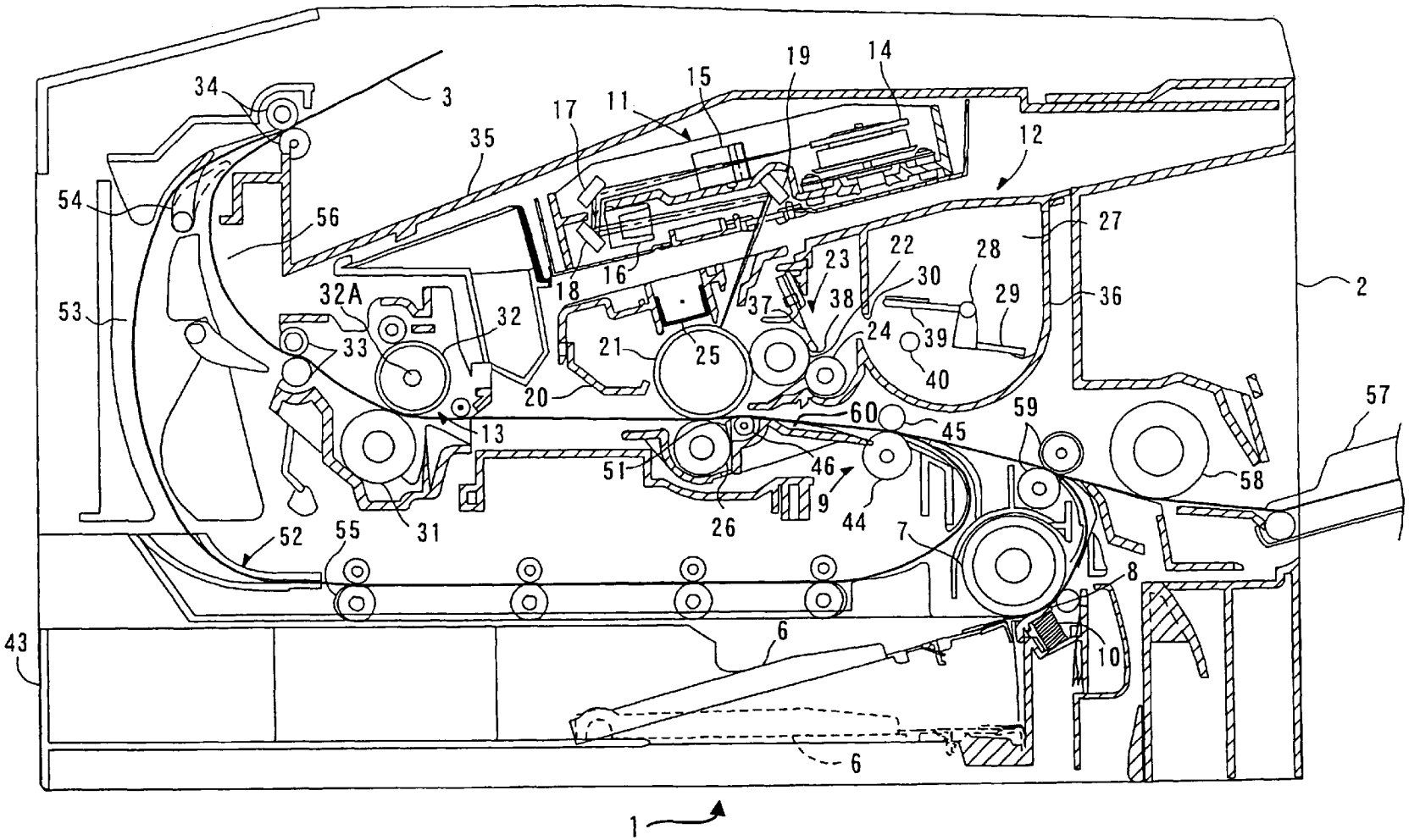
FIG. 1 is a side cross-sectional view showing essential parts of a laser printer according to an exemplary embodiment of the invention.

Referring to FIG. 1, configuration of a laser printer 1 will be described below. As shown in FIG. 1, the laser printer 1 is provided with a paper tray 43 at the bottom of a main casing 2. The paper tray 43 is detachably set in the casing 2. Provided in the paper tray 43 is a paper pressure plate 6 that presses paper sheets 3 set in the paper tray 43 upwardly. Disposed at one upper end of the paper tray 43 are a pick-up roller 7 and a separation pad 8. First paper supply rollers 59 are disposed downstream of the pick-up roller 7 in a feeding direction of the paper sheet 3. Register rollers 9 are disposed downstream of the first paper supply rollers 59 in the feeding direction of the paper sheet 3.

The paper pressure plate 6 supports a stack of the paper sheets 3. The paper pressure plate 6 pivots on one end far from the pick-up roller 7, so that the other end of the paper pressure plate 6 near the pick-up roller 7 can move up and down. A spring (not shown) is disposed on the underside of the paper pressure plate 6. The spring urges the plate 6 upwardly. As the amount of the paper sheets 3 stacked on the pressure plate 6 increases, the pressure plate 6 pivots downward about the one end far from the pick-up roller 7, against an urging force of the spring. The pick-up roller 7 and the separation pad 8 are disposed so as to face each other. A spring 10 disposed on the underside of the separation pad 8 presses the separation pad 8 against the pick-up roller 7.

The topmost paper sheet 3 on the pressure plate 6 is pressed against the pick-up roller 7 by the spring (not shown) disposed on the underside of the pressure plate 6. As the pick-up roller 7 rotates, the topmost paper sheet 3 is picked up and fed between the pick-up roller 7 and the separation pad 8. The paper sheet 3 is then fed by the first paper supply rollers 59 in the paper sheet feeding direction to the register rollers 9. The register rollers 9 include a drive roller 44 provided on the main casing 2 and a follower roller 45 that rotates following or driven by, the rotation of the drive roller 44. The follower roller 45 is provided on a process unit 12, which will be described in detail. A surface of the drive roller 44 contacts a surface of the follower roller 45. The paper sheet 3 fed from the first paper supply rollers 59 is held between the drive roller 44 and the follower roller 45 and conveyed downstream in the paper sheet feeding direction. The drive roller 44 does not rotate until an edge of the paper sheet 3 makes contact with the drive roller 44 and the follower roller 45. As the register rollers 9 correct the positioning or alignment of the paper sheet 3, the drive roller 44 starts to rotate to feed the paper sheet 3 downstream in the paper sheet feeding direction.

Provided on one side of the main casing 2 are a manual feed tray 57 for supplying the paper sheet 3 manually set thereon and a manual feed roller 58 that feeds the paper sheet 3 placed on the manual feed tray 57. The paper sheet 3 supplied from the manual feed tray 57 is conveyed by the manual feed roller 58 to the first paper supply rollers 59.

The laser printer 1 further includes a scanner unit 11, the process unit 12, and a fixing unit 13 in the casing 2.

The scanner unit 11 is provided in an upper portion of the casing 2. The scanner unit 11 includes a laser emitting section (not shown), a polygon mirror 14 that is driven so as to spin, lenses 15, 16, and reflecting mirrors 17, 18, 19. A laser beam emitted from the laser emitting section is modulated based on image data As indicated by broken lines in FIG. 1, the laser beam emitted from the laser emitting section passes through or reflects off the polygon mirror 14, the lens 15, the reflecting mirrors 17, 18, the lens 16, and the reflecting mirror 19 in order. The laser beam scans at high speed across a surface of a photosensitive drum 21, which will be described below in more detail.

Figure 2:
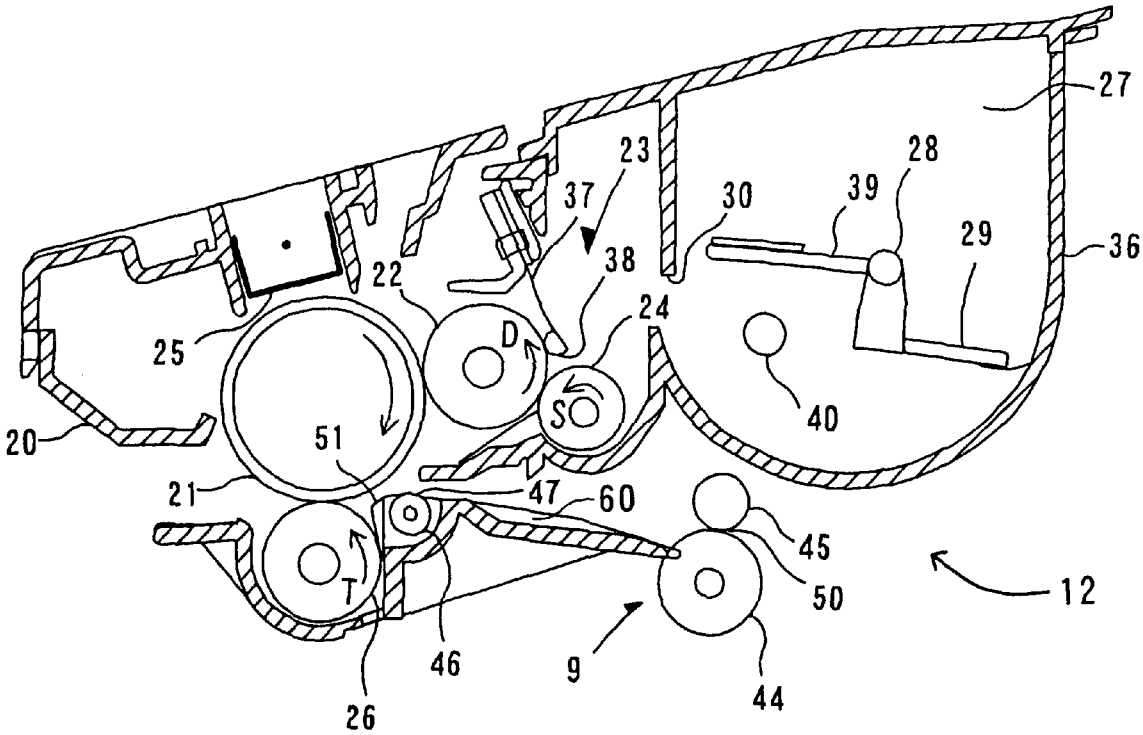
FIG. 2 is an enlarged cross-sectional view showing a process unit of the laser printer.

FIG. 2 is an enlarged cross-sectional view showing the process unit 12. The process unit 12, such as shown in FIG. 2, is disposed below the scanner unit 11. The process unit 12 includes a photosensitive member cartridge 20 detachably mounted on the casing 2 and a developing cartridge 36 detachably mounted on the photosensitive member cartridge 20. The photosensitive member cartridge 20 includes the photosensitive drum 21, a charger 25 of a scorotron type, a transfer roller 26, and a roller 46. The developing cartridge 36 includes a developing roller 22, a toner thickness regulating blade 23, a toner supply roller 24, and a toner box 27.

The toner box 27 accommodates a positively charging, non-magnetic, single component toner as a developing agent. The toner to be used is polymerized toner that is obtained by copolymerizing monomers, such as styrene-based monomers, for example, styrene, and polymerizable monomers, such as acrylic-based monomers, for example, acrylic acid, alkyl (1–4C) acrylate, and alkyl (1–4C) methacrylate, using a known polymerization method, such as a suspension polymerization method. Polymerized toner particles are spherical in shape, having excellent fluidity. The toner is mixed with a coloring material, such as a carbon black, and wax, as well as silica as an external additive to improve the fluidity of the toner. A toner particle size is approximately 6 to 10 $\mu$m.

Disposed in a substantially central portion of the toner box 27 is a rotating shaft 28. The rotating shaft 28 supports an agitator 29 that agitates the toner in the toner box 27. The toner is discharged from a toner supply opening 30 provided in the toner box 27. Provided in a side wall of the toner box 27 is a window 40 for detecting the amount of toner remaining in the toner box 27. The window 40 is cleaned by a cleaner 39 supported by the rotating shaft 28.

Disposed to a side of the toner supply opening 30 is the toner supply roller 24 capable of rotating in the direction indicated in FIG. 2 by the arrow S (in the counterclockwise direction). Disposed opposite to the toner supply roller 24 is the developing roller 22 capable of rotating in the direction indicated in FIG. 2 by the arrow D (in the counterclockwise direction).

The toner supply roller 24 includes a metal roller shaft covered with a conductive foam material. The developing roller 22 includes a metal roller shaft covered with a conductive rubber material. More specifically, a portion of the developing roller 22 covered with the conductive rubber material is formed of conductive urethane rubber or silicone rubber including fine carbon particles whose surface is coated with urethane rubber or silicone rubber including fluorine.

Portions of the toner supply roller 24 and the developing roller 22, covered with the conductive foam or rubber material, have elasticity. The toner supply roller 24 and the developing roller 22 contact each other so as to apply some pressure to one another. A bias is applied to the developing roller 22.

Disposed adjacent to the developing roller 22 is the toner thickness regulating blade 23 that regulates the thickness of the toner on the developing roller 22. The regulating blade 23 includes a blade portion 37 formed of a metal plate spring and a contact portion 38 attached to one end of the blade portion 37. The contact portion 38 has a semicircular cross-sectional shape and is formed of insulating silicone rubber. The other end of the blade portion 37 is supported near the developing roller 22 by the developing cartridge 36. The contact portion 38 presses the developing roller 22 with the elasticity of the plate spring.

The toner discharged through the toner supply opening 30 is supplied onto the toner supply roller 24 and further onto the developing roller 22 by the rotation of the toner supply roller 24. The toner is positively charged through friction charging at the contact portion of the toner supply roller 24 and the developing roller 22. As the developing roller 22 rotates, the toner supplied onto the developing roller 22 passes between the contact portion 38 of the regulating blade 23 and the developing roller 22 where the toner is sufficiently charged through friction charging. The toner passing between the contact portion 38 and the developing roller 22 is formed into a uniform-thickness thin toner layer on the developing roller 22.

Disposed to a side of the developing roller 22 is the photosensitive drum 21 capable of rotating in the direction indicated in FIG. 2 by an arrow (in the clockwise direction). The photosensitive drum 21 is provided so as to face the developing roller 22, with a predetermined distance therebetween. The photosensitive drum 21 includes a main drum which is grounded. The surface of the photosensitive drum 21 is formed by a positively charging photosensitive layer including polycarbonate.

The charger 25 is disposed above the photosensitive drum 21 with a predetermined distance therebetween, to prevent the charger 25 from contacting the photosensitive drum 21. The charger 25 is a positively charging scorotron charger that generates corona discharge from a tungsten wire. The charger 25 uniformly and positively charges the surface of the photosensitive drum 21.

A laser beam emitted from the scanner unit 11 scans at high speed across the surface of the photosensitive drum 21, which is uniformly and positively charged by the charger 25. The surface of the photosensitive drum 21 is selectively exposed to the laser beam, forming an electrostatic latent image thereon, based on image data. By the rotation of the developing roller 22 having the positively charged toner thereon, the toner is brought into contact with the photosensitive drum 21. The toner is supplied to the electrostatic latent image formed on the surface of the photosensitive drum 21, making the toner image visible.

The transfer roller 26 is disposed opposite to and below the photosensitive drum 21. The transfer roller 26 is supported in the photosensitive member cartridge 20 rotatable in the direction indicated in FIG. 2 by the arrow T (in the counterclockwise direction). The transfer roller 26 includes a metal roller shaft covered with a conductive rubber material. A bias is applied to the transfer roller 26. The toner forming the visible toner image on the photosensitive drum 21 is transferred onto the paper sheet 3 by the application of an electric field generated by the bias application, while the paper sheet 3 passes between the photosensitive drum 21 and the transfer roller 26.

The fixing unit 13 is disposed downstream of the process unit 12 in the paper sheet feeding direction, as shown in FIG. 1. The fixing unit 13 includes a heat roller 32 and a pressure roller 31 that is pressed against the heat roller 32, as well as a pair of second paper supply rollers 33 disposed downstream of the heat roller 32 and the pressure roller 31 in the paper sheet feeding direction. The heat roller 32 is formed of aluminum and has a cylindrical shape. The heat roller 32 is provided with a halogen lamp 32A, as a heat source, at a core thereof While the paper sheet 3 passes between the heat roller 32 and the pressure roller 31, the toner transferred onto the paper sheet 3 in the process unit 12 is fused by heat to fixedly adhere the toner to the sheet 3. After the toner is fixedly adhered to the paper sheet 3, the sheet 3 is conveyed, by the second paper supply rollers 33, to a discharge path 56. The paper sheet 3 comes into contact with discharge rollers 34, through the discharge path 56, and is discharged by the discharge rollers 34 onto a discharge tray 35.

After the image is transferred, using the transfer roller 26, onto the paper sheet 3, the toner which remains on the photosensitive drum 21 is collected into the developing cartridge 36 with the potential difference between the developing roller 22 and the photosensitive drum 21. With this structure, the laser printer 1 does not have to be provided with a structure to collect the toner remaining on the photosensitive drum 21 by scrapping the toner off the drum 21 for the collection thereof Therefore, the laser printer 1 may have a simplified structure and a smaller size, thereby achieving a cost reduction.

To form images on both sides of the paper sheet 3, the laser printer 1 includes a duplex printing unit 52. The duplex printing unit 52 includes the discharge rollers 34, a reverse feeding path 53, a flapper 54, and a conveying belt 55.

The discharge rollers 34 are a pair of rollers that can rotate in a forward or a reverse direction. The discharge rollers 34 rotate in the forward direction to discharge the paper sheet 3 onto the discharge tray 35. The discharge rollers 34 rotate in the reverse direction to reversely feed the paper sheet 3.

The reverse feeding path 53 is provided in the up-and-down directions, to feed the paper sheet 3 from the discharge rollers 34 to the conveying belt 55 disposed above the paper tray 43. An upstream-side end of the reverse feeding path 53 in the paper sheet feeding direction is disposed close to the discharge rollers 34. A downstream-side end of the reverse feeding path 53 is disposed close to the conveying belt 55.

The flapper 54 is movably provided so as to face a point where the discharge path 56 and the reverse feeding path 53 are branched. The flapper 54 is swung by the excitation or non-excitation of a solenoid (not shown), to direct the paper sheet 3 to the discharge rollers 34 through discharge path 56, or to direct the sheet 3 to the reverse feeding path 53 from the discharge rollers 34.

The conveying belt 55 is disposed above the paper tray 43 to be substantially horizontal. An upstream-side end of the conveying belt 55 in the paper sheet feeding direction is disposed close to the downstream-side end of the reverse feeding path 53. A downstream-side end of the conveying belt 55 is disposed below the register rollers 9.

The operation of the duplex printing unit 52, for printing on both sides of the paper sheet 3, will be described below. As the paper sheet 3, having an image formed on one side thereof, is fed to the discharge rollers 34 by the second paper supply rollers 33 through the discharge path 56, the discharge rollers 34 holding the sheet 3 therebetween rotate in the forward direction to feed the sheet 3 toward the discharge tray 35. When the trailing edge of the paper sheet 3 is held between the discharge rollers 34 while the sheet 3 is being discharged onto the discharge tray 35, the rotation of the discharge rollers 34 in the forward direction stops. The timing when the rotation of the discharge rollers 34 is stopped is determined by the rotating speed of the discharge rollers 34 and the size of the paper sheet 3.

Thereafter, the discharge rollers 34 rotate in the reverse direction. The flapper 54 is operated so as to direct the paper sheet 3 into the reverse feeding path 53 from the discharge tray 35. The paper sheet 3 is reversely fed into the reverse feeding path 53. As the paper sheet 3 is fed into the reverse feeding path 53, the flapper 54 returns to its original position, that is, the flapper 54 is swung to enable the paper sheet 3 conveyed by the second paper supply rollers 33, to be conveyed to the discharge rollers 34.

The paper sheet 3 is fed to the conveying belt 55, through the reverse feeding path 53, and from the conveying belt 55 to the register rollers 9. The register rollers 9 correct the positioning or alignment of the paper sheet 3 fed with a printed side thereof facing downwardly. Then, the sheet 3 is transported to the process unit 12 where the image is formed on the other side of the sheet 3. Thus, the images are formed on both sides of the paper sheet 3.

The roller 46 is disposed upstream of the transfer roller 26 in the paper sheet feeding direction, near the transfer roller 26 of the photosensitive member cartridge 20. The roller 46 guides the paper sheet 3 between the photosensitive drum 21 and the transfer roller 26. The roller 46 is a non-driven component and is not driven by a drive source, such as a motor.

Figure 3:
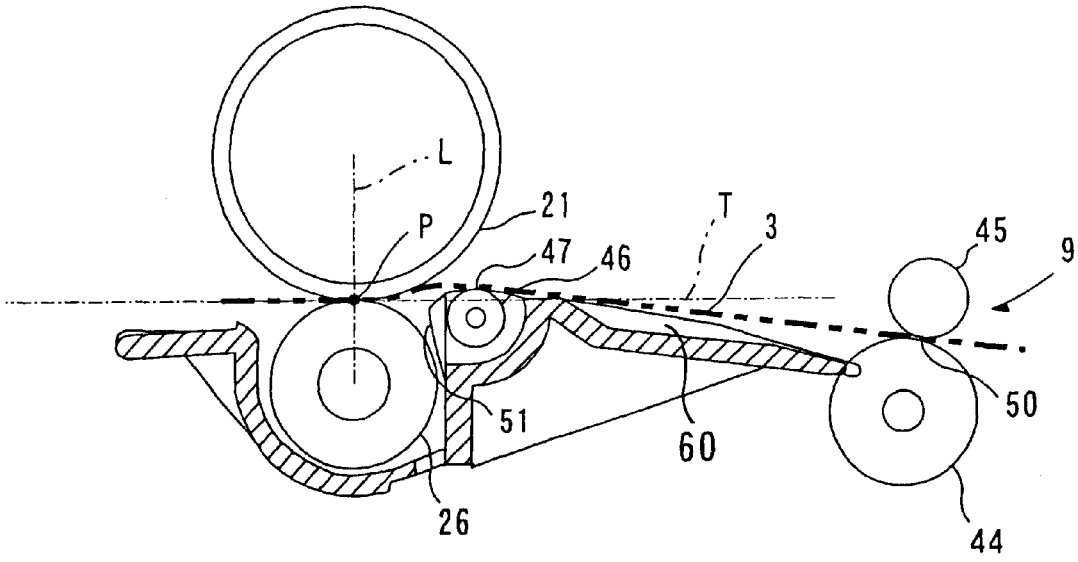
FIG. 3 is an enlarged partially cross-sectional view showing a photosensitive member cartridge and the essential parts of the laser printer.

The roller 46 will be described in detail below. In FIG. 3, a line L shows a segment that links the center of the photosensitive drum 21 and the center of the transfer roller 26. A point P shows an intersection of the line segment L and the circumference of the photosensitive drum 21. A line T shows a line tangent to the circumference of the photosensitive drum 21 at the point P. The roller 46 is provided so as to dispose a contact surface 47 where the roller 46 and the paper sheet 3 contact each other, to a side of the photosensitive drum 21, with respect to the tangent line T. The contact surface 47 is disposed to a side of the photosensitive drum 21 (upper side) in the line segment L extending direction, with respect to a contact surface 50 where the drive roller 44 and the follower roller 45 contact each other. That is, the contact surface 50 is disposed to a side of the transfer roller 26 (lower side) in the line segment L extending direction, with respect to the contact surface 47.

Formed in the photosensitive member cartridge 20 is a guide 60 that guides the paper sheet 3 passing through the register rollers 9 upwardly toward the roller 46.

Figure 4:
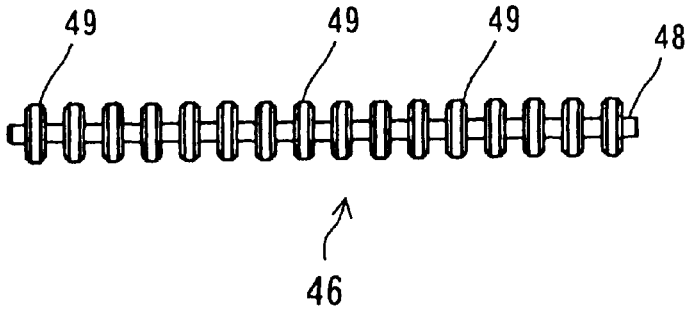
FIG. 4 is a front view of a roller of the laser printer.

As shown in FIG. 4, the roller 46 includes a shaft 48 and a plurality of disks 49 integrally formed of a resin material. The plurality of the disks 49 is provided with a predetermined distance between adjacent discs, along the direction of the length of the shaft 48. A diameter of each disk 49 is half the diameter of the transfer roller 26 or smaller. Each end of the shaft 48 is rotatably supported upstream of the transfer roller 26 in the paper sheet feeding direction, near the transfer roller 26 on each side of the photosensitive member cartridge 20 in the width direction thereof, so that the shaft 48 of the roller 46 is supported in a generally "V"-shaped area defined by the photosensitive drum 21 and the transfer roller 26. The length of the roller 46 corresponds to the total length of the photosensitive drum 21. The roller 46 may be divided into a plurality of parts. The divided parts of the roller 46 may be disposed along the lengthwise direction of the photosensitive drum 21.

The paper sheet 3 fed by the register rollers 9 is guided by the guide 60, to the contact surface 47 of the roller 46. The contact surface 47 is positioned to the side of the photosensitive drum 21, with respect to the tangent line T, i.e., a portion of the roller 46 lies above (as shown in FIG. 3) tangent line T. Accordingly, the paper sheet 3 first comes into contact with the photosensitive drum 21 with the rotation of the roller 46. The paper sheet 3 contacting the photosensitive drum 21 is then brought into intimate contact with the surface of the photosensitive drum 21, so as to wind around the surface of the drum 21. The paper sheet 3 being in intimate contact with the surface of the drum 21 is fed between the photosensitive drum 21 and the transfer roller 26. The toner is transferred onto the paper sheet 3 at a nip portion where the sheet 3 is nipped between the photosensitive drum 21 and the transfer roller 26.

If the roller 46 is not provided, a gap is formed between the photosensitive drum 21 and the paper sheet 3, which is fed by the register rollers 9, just before the paper sheet 3 is fed between the photosensitive drum 21 and the transfer roller 26. In such a case, an electric discharge occurs at the gap due to the bias applied to the transfer roller 26, leading to poor image transfer.

The roller 46 is provided in the above-described exemplary embodiment. Therefore, the paper sheet 3, which is subjected to the image transfer processes, may be brought into intimate contact with the surface of the photosensitive drum 21, so as to wind around the surface of the drum 21. With the roller 46, the gap where the electric discharge occurs is not formed between the paper sheet 3 and the photosensitive drum 21. Thus, reduction in print quality due to poor image transfer can be prevented.

The paper sheet 3 moves on the contact surface 47 of the roller 46, while being pressed against the contact surface 47, with a sheet transferring force at the nip portion where the paper sheet 3 is nipped between the photosensitive drum 21 and the transfer roller 26. Friction between the roller 46 and the paper sheet 3 is reduced by the rotation of the roller 46. Therefore, wear or abrasion of the roller 46 caused by a frictional sliding of the paper sheet 3 is reduced during the long period of usage of the laser printer 1. Reduction in wear or abrasion of the roller 46 prevents the gap between the paper sheet 3 and the photosensitive drum 21 from being formed, resulting in no electrical discharge therebetween. Consequently, a high-quality image may be formed by the laser printer 1 during the long period of usage.

In the above-described exemplary embodiment, the roller 46 is provided so as to dispose the contact surface 50 between the drive roller 44 and follower roller 45, of the register rollers 9, to the side of the transfer roller 26 (lower side), with reference to the line segment L extending direction, with respect to the contact surface 47. When the sheet transferring force is applied to the paper sheet 3 at the nip portion where the sheet 3 is nipped between the photosensitive drum 21 and the transfer roller 26, the sheet 3 is in tension while being pulled between the transfer roller 26 and the register rollers 9, over the roller 46. Thus, the paper sheet 3 is held between the photosensitive drum 21 and the transfer roller 26, without slack in the sheet 3. The toner is transferred onto the paper sheet 3 in a stable manner. Therefore, the possibility of poor image transfer is reduced.

The contact surface 47 of the roller 46 is pressed by the paper sheet 3 and would normally be prone to wear or abrasion due to the frictional sliding of the sheet 3 thereon. However, because the roller 46 is rotatably provided, such wear or abrasion can be effectively reduced.

The roller 46, having a tubular shape, may be integrally formed of a resin material. However, the odds are high that the molded tubular-shaped roller 46 has variations in a wall thickness or diameter thereof. If the roller 46 is molded with a plurality of the disks 49 provided on the shaft 48, as described in the above exemplary embodiment, the roller 46 having a uniform diameter may be accurately formed. With the roller 46 accurately formed, the paper sheet 3 may be properly guided so as to come into intimate contact with the photosensitive drum 21. Accordingly, the poor image transfer due to the electric discharge between the paper sheet 3 and the photosensitive drum 21 can be reduced.

The diameter of each disk 49 is half the diameter of the transfer roller 26 or smaller, so that the roller 46 may be disposed close to the nip portion between the photosensitive drum 21 and the transfer roller 26. Thus, the paper sheet 3 may be stably guided between the photosensitive drum 21 and the transfer roller 26 and the toner can be stably transferred onto the paper sheet 3, so that the likelihood of a poor image transfer can be reduced.

The roller 46 is provided in the photosensitive member cartridge 20 that is detachably mounted on the casing 2. The photosensitive member cartridge 20 can be detachably set in the casing 2 together with the developing cartridge 36, in the form of the process unit 12. The developing cartridge 36 may be detached from the photosensitive member cartridge 20 after the process unit 12 is removed from the casing 2.

The roller 46 may be replaced after the process unit 12 is first removed from the casing 2 and then the developing cartridge 36 is removed from the photosensitive member cartridge 20.

An endurance period of the roller 46 may be set to a period from a start of using a newly mounted developing cartridge 36, to a time when replacement of the developing cartridge 36 is required, due to the toner box 27 running out of the toner. Thus, the maintenance of the laser printer 1 can be facilitated. The endurance period of the roller 46 can also be set to approximately the same period as an endurance period of the photosensitive drum 21. In this case, the roller 46 can be replaced with new one at the same time as when the photosensitive member cartridge 20 is replaced, so that the maintenance of the laser printer 1 is facilitated.

The photosensitive drum 21, the transfer roller 26, and the roller 46 are all mounted on the photosensitive member cartridge 20, so that the positional accuracy of the photosensitive drum 21, the transfer roller 26, and the roller 46 relative to each other is improved. The paper sheet 3 is properly guided so as to come into intimate contact with the photosensitive drum 21, by the roller 46 mounted with improved positional accuracy. Thus, occurrence of the electric discharge at the time of the image transfer can be prevented. Consequently, a high-quality image can be formed.

As shown in FIG. 3, a supporting member 51 is disposed between the roller 46 and the transfer roller 26 in the photosensitive member cartridge 20. The supporting member 51 supports the paper sheet 3 guided by the roller 46.

The supporting member 51 is formed in a substantially triangular shape, when viewed from a side, with a comer protruding toward the nip portion between the photosensitive drum 21 and the transfer roller 26. A plurality of supporting members 51 are integrally formed in a rib-like shape of a resin material in the photosensitive member cartridge 20, in a shaft 48 extending direction. An uppermost portion of the supporting member 51 is disposed below the contact surface 47 of the roller 46 and on or above the tangent line T. The comer of the supporting member 51 protruding toward the nip portion is disposed on or below the tangent line T. The supporting member 51 supports the paper sheet 3 fed by the roller 46 and guides it between the nip portion between the photosensitive drum 21 and the transfer roller 26.

The supporting member 51 supports the paper sheet 3 guided through the rotation of the roller 46 and transfers the sheet 3 smoothly and favorably between the nip portion between the photosensitive drum 21 and the transfer roller 26. When the trailing edge of the paper sheet 3 passes through the roller 46 and comes out of the contact therewith, the supporting member 51 supports the trailing edge of the paper sheet to prevent the trailing edge of the sheet 3 from slipping down between the transfer roller 26 and the roller 46. Accordingly, the paper sheet 3 can be fed between the photosensitive drum 21 and the transfer roller 26 without forming a gap between the sheet 3 and the photosensitive drum 21. This eliminates the occurrence of an electric discharge between the paper sheet 3 and the photosensitive drum 21, resulting in the reduction of the image transfer. The uppermost portion of the supporting member 51 is disposed below the contact surface 47 of the roller 46, so that the supporting member 51, is substantially, not subjected to the frictional sliding of the paper sheet 3, resulting in no wear or abrasion.

The friction generated by the paper sheet 3 may be reduced by the rotation of the roller 46, so that generation of paper powders is reduced. Because the generation of paper powders is reduced, mixture of the paper powders into the toner on the photosensitive drum 21 to be collected after image transfer is finished, as in the above-described exemplary embodiment, can be prevented. This prevents the reduction of the toner quality, so that the reduction of the image quality can also be prevented.

Because the laser printer 1, according to the exemplary embodiment of the invention, is provided with the duplex printing unit 52, the images may be formed on both sides of the paper sheet 3. When the heat is applied by the fixing unit 13 to the paper sheet 3 to form an image on one side thereof, electrical resistance specific to the paper sheet 3 increases. With the increase in the electrical resistance, the electric discharge is likely to occur between the paper sheet 3 and the photosensitive drum 21, when an image is formed on the other side of the paper sheet 3, due to the bias applied to the transfer roller 26.

However, the occurrence of such electric discharge may be effectively prevented in the exemplary embodiment, as the roller 46 guides the paper sheet 3 so as to come into intimate contact with the photosensitive drum 21. Thus, the poor image transfer may be reduced, and the images may be formed on both sides of the paper sheet 3.

In the above-described exemplary embodiment, as shown in FIG. 3, the contact surface 47 of the roller 46 is disposed to the side of the photosensitive member 21 (upper side), with respect to the line T tangent to the circumference of the photosensitive drum 21 at the point P. The contact surface 50 of the register rollers 9 is disposed to the side of the transfer roller 26 (lower side), with respect to the line segment L extending direction, relative to the contact surface 47 of the roller 46. However, as shown in FIG. 5, the roller 46 may be provided so as to dispose the contact surface 47 thereof to the side of the transfer roller 26 (lower side), with respect to the line T tangent to the circumference of the photosensitive drum 21 at the point P, and so as to dispose the contact surface 50 of the register rollers 9 to the side of the transfer roller 26 (lower side), with respect to the line segment L extending direction, relative to the contact surface 47 of the roller 46.

Figure 5:
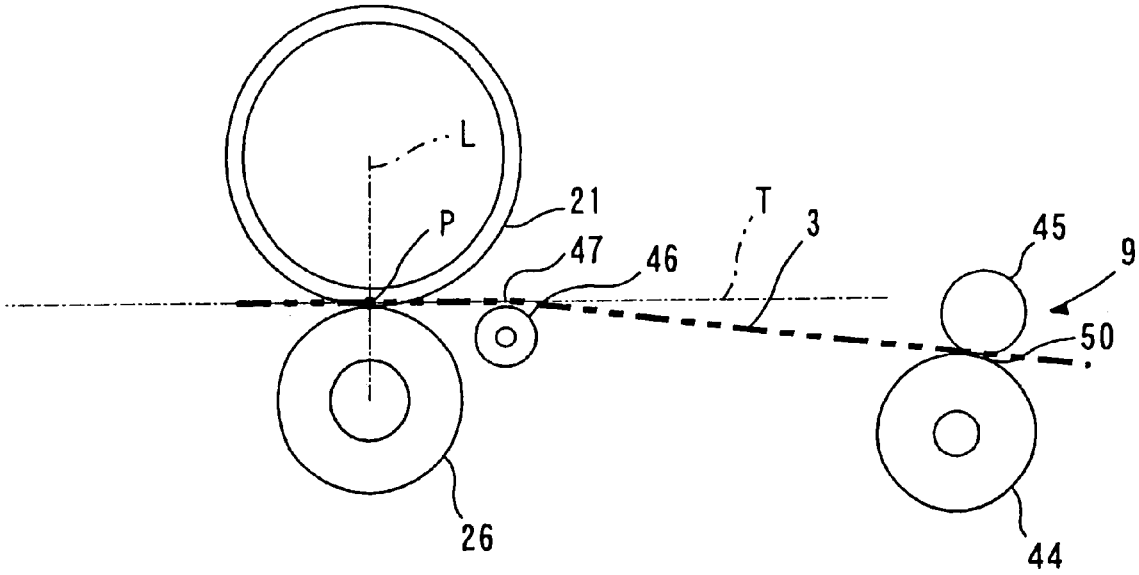
FIG. 5 is an enlarged cross-sectional view showing a modification of the photosensitive member cartridge.

When the roller 46 and the register rollers 9 are disposed as shown in FIG. 5, the paper sheet 3 is in tension while being pulled between the transfer roller 26 and the register rollers 9, past the roller 46, with the sheet transferring force applied to the paper sheet 3 at the nip portion where the sheet 3 is nipped between the photosensitive drum 21 and the transfer roller 26. Thus, the paper sheet 3 is held between the photosensitive drum 21 and the transfer roller 26, without slack in the sheet 3. The toner is transferred onto the paper sheet 3 in a stable manner. The contact surface 47 of the roller 46 is pressed by the paper sheet 3, so that the roller 46 normally would be subjected to wear or abrasion, due to the frictional sliding of the paper sheet 3. However, such wear or abrasion may effectively be reduced because the roller 46 is rotatable.

While the invention has been described with reference to the exemplary embodiment, it is to be understood that the invention is not restricted to the particular forms shown in the foregoing exemplary embodiment. Various modifications and alterations can be made thereto without departing from the scope of the invention.

What is claimed is:

1. An image forming apparatus, comprising:

a photosensitive member that carries an image formed thereon by a developing agent;

a transfer member that transfers the image formed on the photosensitive member to a recording medium, the transfer member being provided at a position relative to the photosensitive member;

a feeding member that feeds the recording medium between the photosensitive member and the transfer member; and a roller that guides the recording medium fed by the feeding member between the photosensitive member and the transfer member, the roller being rotatably provided and is freely rotatable.

2. The image forming apparatus according to claim 1, wherein the photosensitive member is a photosensitive drum having a tubular shape, wherein the transfer member is a transfer roller having a cylindrical shape, and wherein a contact surface where the roller and the recording medium contact each other is disposed to a side of the photosensitive drum, with respect to a line tangent to a circumference of the photosensitive drum at an intersection of a line segment that links a center of the photosensitive drum and a center of the transfer roller, and the circumference of the photosensitive drum.

3. The image forming apparatus according to claim 2, wherein a contact surface where the feeding member and the recording medium contact each other is disposed to a side of the transfer roller in an extending direction of the line segment, with respect to the contact surface where the roller and the recording medium contact each other.

4. The image forming apparatus according to claim 2, wherein a diameter of the roller is half a diameter of the transfer roller or smaller.

5. The image forming apparatus according to claim 1, further comprising a process unit detachably mounted on the image forming apparatus, wherein the photosensitive member, the transfer member, and the roller are provided in the process unit.

6. The image forming apparatus according to claim 1, wherein the roller includes a shaft and a plurality of disks provided in a lengthwise direction of the shaft with a distance therebetween.

7. The image forming apparatus according to claim 1, further comprising a supporting member that is provided between the transfer member and the roller and that supports the recording medium guided by the roller.

8. The image forming apparatus according to claim 1, further comprising a developing member that supplies the developing agent to the photosensitive member, wherein the developing member collects the developing agent remaining on the photosensitive member after the image is transferred from the photosensitive member to the recording medium by the transfer member.

9. The image forming apparatus according to claim 1, further comprising a transport member that transports the recording medium having the image formed on one side thereof to the feeding member.

10. A process unit, comprising:

a photosensitive member that carries an image formed thereon by a developing agent;

a transfer member that transfers the image formed on the photosensitive member to a recording medium, the transfer member being provided at a position relative to the photosensitive member; and a roller that guides the recording medium between the photosensitive member and the transfer member, the roller being rotatably provided and is freely rotatable.

11. The process unit according to claim 10, wherein the photosensitive member is a photosensitive drum having a tubular shape, wherein the transfer member is a transfer roller having a cylindrical shape, and a contact surface where the roller and the recording medium contact each other is disposed to a side of the photosensitive drum, with respect to a line tangent to a circumference of the photosensitive drum at an intersection of a line segment that links a center of the photosensitive drum and a center of the transfer roller, and the circumference of the photosensitive drum.

12. The process unit according to claim 11, wherein a diameter of the roller is half a diameter of the transfer roller or smaller.

13. The process unit according to claim 10, wherein the roller includes a shaft and a plurality of disks provided in a lengthwise direction of the shaft with a predetermined distance therebetween.

14. The process unit according to claim 10, further comprising a supporting member that is provided between the transfer member and the roller and that supports the recording medium guided by the roller.

15. An image forming apparatus, comprising:

a photosensitive member that carries an image formed thereon by a developing agent;

a transfer member that transfers the image formed on the photosensitive member to a recording medium, the transfer member being provided at a position relative to the photosensitive member;

a feeding member that feeds the recording medium between the photosensitive member and the transfer member; and a guiding member, the guiding member being freely rotatable, that guides the recording medium fed by the feeding member between the photosensitive member and the transfer member, after the recording medium is brought into intimate contact with a surface of the photosensitive member.

16. An image forming apparatus, comprising:

a photosensitive drum;

a transfer roller in contact with the photosensitive drum to define a nip therebetween; and a guide roller upstream of the nip, a portion of an outer circumference of the guide roller extending to a side of a first plane where the photosensitive drum is located, the first plane transverse to a second plane passing through centers of rotation of the photosensitive drum and the transfer roller, the guide roller being freely rotatable.

17. The image forming apparatus according to claim 16, wherein the guide roller comprises a plurality of discs spaced along an axial rod.

18. The image forming apparatus according to claim 16, further comprising a process unit, wherein the photosensitive drum, transfer roller and guide roller are mounted in the process unit.

19. The image forming apparatus according to claim 17, further comprising a process unit comprising a developing cartridge and a photosensitive member cartridge, the photosensitive drum, the transfer roller, and the guide roller mounted in the photosensitive member cartridge.

20. The image forming apparatus according to claim 17, wherein a diameter of each disc of the plurality of discs is no greater than one-half a diameter of the transfer roller.

21. An image forming apparatus, comprising:

a photosensitive drum;

a transfer roller in contact with the photosensitive drum to define a nip therebetween; and a guide roller upstream of the nip, an entire outer circumference of the guide roller to a side of a first plane where the transfer roller is located, the first plane transverse to a second plane passing through centers of rotation of the photosensitive drum and the transfer roller.

22. The image forming apparatus according to claim 21, wherein the guide roller comprises a plurality of discs spaced along an axial rod.

23. The image forming apparatus according to claim 21, wherein a diameter of each disc of the plurality of discs is no greater than one-half a diameter of the transfer roller.

24. The image forming apparatus according to claim 21, further comprising a pair of register rollers upstream of the guide roller, a nip of the register rollers further from the side of the plane where the transfer roller is located than the portion of the outer circumference of the guide roller and the recording medium is in tension between the nip between the photosensitive drum and the transfer roller and the nip between the register rollers.

25. The image forming apparatus according to claim 21, further comprising a process unit, wherein the photosensitive drum, transfer roller and guide roller are mounted in the process unit.

* * * * *